US005522427A

United States Patent [19]

Johnson

[11] Patent Number: 5,522,427

[45] Date of Patent: Jun. 4, 1996

[54] RAIN WATER CONVEYANCE APPARATUS

[76] Inventor: Charles L. Johnson, 1009 Brock, Corpus Christi, Tex. 78412

[21] Appl. No.: 404,650

[22] Filed: Mar. 15, 1995

[51] Int. Cl.[6] ..... F16L 27/00

[52] U.S. Cl. ..... 137/616.5; 52/16; 137/615

[58] Field of Search ..... 52/16; 137/615, 137/616.5

[56] References Cited

U.S. PATENT DOCUMENTS

| | | | |
|---|---|---|---|
| 427,206 | 5/1890 | Suddick . | |
| 2,567,004 | 9/1951 | Benck | 137/80.1 |
| 2,930,392 | 3/1960 | Smith | 137/119 |
| 2,975,805 | 3/1961 | Horn | 137/615 |
| 3,060,952 | 10/1962 | Bystrom | 137/80.1 |
| 3,316,928 | 5/1967 | Weakley | 137/615 |
| 3,375,851 | 4/1968 | Henry | 137/615 |
| 3,911,954 | 10/1975 | Johnson | 137/615 |
| 4,135,540 | 1/1979 | Felsen | 137/615 |
| 4,270,572 | 6/1981 | Jarzynka | 137/615 |
| 5,014,745 | 5/1991 | Watt | 137/615 |
| 5,358,006 | 10/1994 | Sweers | 137/615 |
| 5,358,007 | 10/1994 | Carlberg | 137/615 |

OTHER PUBLICATIONS

Miscellaneous Advertisements (undated) 1 page.

*Primary Examiner*—Gerald A. Michalsky
*Attorney, Agent, or Firm*—George S. Gray

[57] ABSTRACT

An apparatus for conveying rain water to a point remote from a building wall, comprising a frame mounted trough which is automatically lowered in response to movement of a piston within the frame. The piston moves in response to the weight of water accumulated within the frame, but is delayed until the rising water level actuates a trough release mechanism. Trough deployment is resisted by the lean of the stored trough and springs which are in tension for all trough positions. Water exits the frame through a cylinder port and drains from the remote end of the trough. A trough stabilizer collects a small amount of water at the end of the trough, the weight of the collected water keeping the trough down until water flow from the trough ceases. Small holes allow slow drainage from the trough stabilizer, which eventually allows the springs to return the trough to its upper position. Provisions are made allow accumulation of water to exit the frame without trough deployment.

44 Claims, 11 Drawing Sheets

RAIN WATER CONVEYANCE APPARATUS

BACKGROUND

My invention relates to the conveyance of water from the rain gutter system of a building to a point remote from the building's wall and foundation.

Current devices typically require manual operation or, if automatic, require relatively large counterweights, exterior collection buckets, etc. Some have no positive trough latch mechanisms, while others have latch mechanisms within the downspout which are susceptible to the accumulation of debris.

In light of the current state of the art, there is a need for a device which, having a minimum of obtrusive, exterior hardware, provides positive retention of the trough until significant rainfall initiates a fully automatic deployment of the trough to its drain position, followed by an automatic return of the trough to its non-drain position.

SUMMARY

My invention is directed to an apparatus, having a minimum of obtrusive, exterior hardware, which will automatically lower and raise a trough in order to transport rain gutter water to a point remote from the building's wall, and which will provide positive retention of the trough during dry weather or light rainfall. The apparatus comprises a piston driven linkage which reacts to the accumulation of a significant amount of water on top of the piston, the water having been directed to the piston through a water passage in the frame of the apparatus. The linkage is attached to a trough which is pivotally attached to the frame and biased to remain in its stowed position. This bias resists downward movement of the piston by virtue of the linkage, such that the piston is not displaced until the force of the water bearing upon the piston exceeds the opposing trough bias force. At that point the piston begins its downward motion, likewise causing the trough to begin its descent. As the piston moves through the frame cylinder it will expose a cylinder outlet port, allowing water to exit the frame, pass through a port chute and enter the trough. When the trough's lower position has been reached the water will freely flow out the remote end of the trough.

The linkage between the piston and the trough can be rigid such that the piston and trough movement will be positively connected during movement of both from their respective upper positions. The linkage may also include a disengagement joint which releases the trough from its rigid connection to the piston at an intermediate point in the trough's descent. If desired the cylinder outlet port can be located such that water begins to enter the trough while the trough is in an intermediate position, allowing the water in the trough to provide additional forces urging the trough to finish its descent.

The source of the trough bias in my apparatus is either or both of the tilt of the trough from the vertical toward the building or a spring which biases the trough toward its upper position, regardless of the position of trough. When a spring is used the trough bias means comprises lower and upper trough return members which form an elbow joint and which are pivotally attached to the frame and the trough, respectively. The spring is attached to the frame and the lower trough return member. Spring adjustment means are provided which comprise a series of spring attachment holes in both the frame and the lower trough return member.

Drainage and debris clearance from the piston top can be assisted by slanting the piston top toward the cylinder outlet port. To properly orient the slant direction with the cylinder outlet port, a cylinder key slot within the cylinder is provided for closely received a piston key, preventing rotation of the piston along the longitudinal axis of the cylinder. Alternatively, such orientation can be achieved by using a non-circular piston and cylinder.

Although not required for basic operation the linkage can also be sized and oriented such that the trough will be substantially horizontal when it is in its lower position.

The efficiency of the apparatus can be increased by using close tolerances between the piston and cylinder or by providing piston upper and lower seal means. Such means have upper and lower cylinder piston seats and piston upper and lower seal rings. The piston lower seal ring is positioned on the lower cylinder piston seat. A seal is formed when borne upon by the piston bottom which is beveled for a close fit. For servicing the lower piston seal ring, a floating piston and linkage connection, such as a ball and socket, is provided in the preferred embodiment such that the linkage may be displaced from the piston. When the cylinder outlet port is sized and positioned in an appropriate manner the lower piston seal ring may be removed through the cylinder outlet port for service while the linkage is separated from the piston.

The preferred embodiment includes a piston upper seal ring which is attached to the piston top, having a flexible bottom portion held in place by a rigid top portion and a screw. The upper cylinder piston seat has radially shaped, downwardly projecting ridges that assist in forming a water seal when the piston upper seal ring bottom portion bears upon the upper cylinder piston seat.

I have provided a trough release in my apparatus which prevents the early release and descent of the trough. It also minimizes trough rattle on windy days. The primary trough release mechanism is attached to the frame (or, in an alternative embodiment, the existing rain gutter discharge hardware) near a point adjacent the trough remote end when the trough is in its upper position. The trough is not released until the height of the water accumulated on the piston reaches the trough release mechanism.

The trough release includes a tab which is attached to the remote end of the trough (or the trough stabilizer as I will discuss later). The mechanism also includes a pivoting member, which has a latch bar attached to its forward end, a container attached to its rearward end, and a pivot point interposed between the forward and rearward end, allowing the pivoting member to pivot between a first position with the latch bar down, and a second position with the latch bar up. When the trough is returning from its lower position the tab will bear upon the latch bar, causing the pivot member to move to its second position, and allowing the tab to pass under the latch bar. Once the tab has passed under the latch bar then the pivoting member returns to its first position. A notch is on the latch bar which closely receives the tab when the tab is between the latch bar and the container.

The trough release container has a vent hole and a water feed hole into which water is received from a water feed passage from the frame water passage when the height of the accumulated water in the frame water passage exceeds the height of the water feed hole. The container is sized such that when it is substantially full the pivoting member will be in its second position, allowing the tab to pass freely under the latch bar.

In an alternative embodiment of my apparatus the connection between the frame and the existing rain gutter discharge is at a point below the trough release. I have provided connection means for attaching portions of the trough release to the rain gutter discharge hardware. In this embodiment the connection between the frame and the existing rain gutter discharge includes a rain gutter discharge seal mechanism to ensure that water will accumulate above the connection to the extent necessary to initiate the piston displacement process and to initiate the trough release. The seal mechanism has a closely fitting resilient seal surrounding the rain gutter discharge. The rain gutter discharge slips into a modified frame top which is borne upon by the seal, and which closely receives most, but not all, of the seal. A seal compressor is attached to the modified frame top which compresses the resilient seal such that it is forced against the rain gutter discharge, forming an effective water seal.

I have provided means for supporting the apparatus and also connecting the apparatus to the rain gutter discharge. The support means allows a choice of holes on the frame to be used with ordinary fasteners which allows the installer to choose optimum building attachment points. The connecting means comprises an ordinary slip fit connection in the preferred embodiment, but comprises a connection mechanism which creates a seal with the rain gutter discharge for embodiments which connect to the existing rain gutter discharge at a point beneath the trough release mechanism, as discussed above.

My apparatus also provides means for draining the small accumulations of water which occur following a light rain. In such cases the weight of the accumulation is often less than that required to overcome the trough bias means. In my invention these small accumulations will slowly drain through the cylinder and out of an opening in the frame bottom end. In the preferred embodiment light rain drainage means are provided, comprising a channel in the piston upper seal ring which allows a slow drainage of the accumulated water through the piston upper seal ring and into the annular area around the piston. In alternative embodiments light rain drainage means are provided including an intended piston and cylinder tolerance which will allow water to slowly leak from the piston top through the annulus between the piston and the cylinder.

I have also provided a drainage diverter which is attached to the frame bottom end and shaped for receiving water from the opening in the frame bottom end and diverting it away from the area immediately below the frame bottom end.

I have included a trough stabilizer for use when my apparatus utilizes a spring for the trough bias means. It is attached to the trough remote end and includes a water collection reservoir and a drain hole. The water collection reservoir collects a portion of the water being discharged from the trough remote end and remains substantially full during such discharge. When substantially full the spring return bias force is overcome and the trough remains in its lower position. When water discharge stops the water collection reservoir will slowly drain through the drain holes and the spring return bias force will cause the trough to return to its upper position. In the preferred embodiment of my apparatus having both the trough release and the trough stabilizer, the trough release tab is attached to the trough stabilizer as opposed to the trough remote end.

My apparatus includes shock absorber means providing energy absorption in those embodiments where the descending trough contacts the ground. The preferred shock absorber means is one in which the trough stabilizer is pivotally attached to the trough remote end, both being attached to a tension spring which absorbs energy while resisting relative rotation between the trough stabilizer and the trough remote end. Other such means include the attachment of typical energy absorbing materials to the bottom surface of the trough, or the trough stabilizer if it is present.

The trough stabilizer is also claimed as an improvement to rain gutter water conveyance devices of the type in which a trough is automatically raised when water flow ceases.

My apparatus is also claimed for other liquids generally, since the operation of the apparatus is not limited to water.

DESCRIPTION OF THE DRAWINGS

These and other features, aspects, and advantages of the present invention will become better understood with regard to the following description, appended claims, and accompanying drawings where:

FIG. 8*b* references cutting plane line 8*b*—8*b* on FIG. 8*a*.

FIG. 9*b* references cutting plane line 9*b*—9*b* on FIG. 9a.

FIG. 10*b* references cutting plane line 10*b*—10*b* on FIG. 10*a*.

DESCRIPTION

Figure 1A:
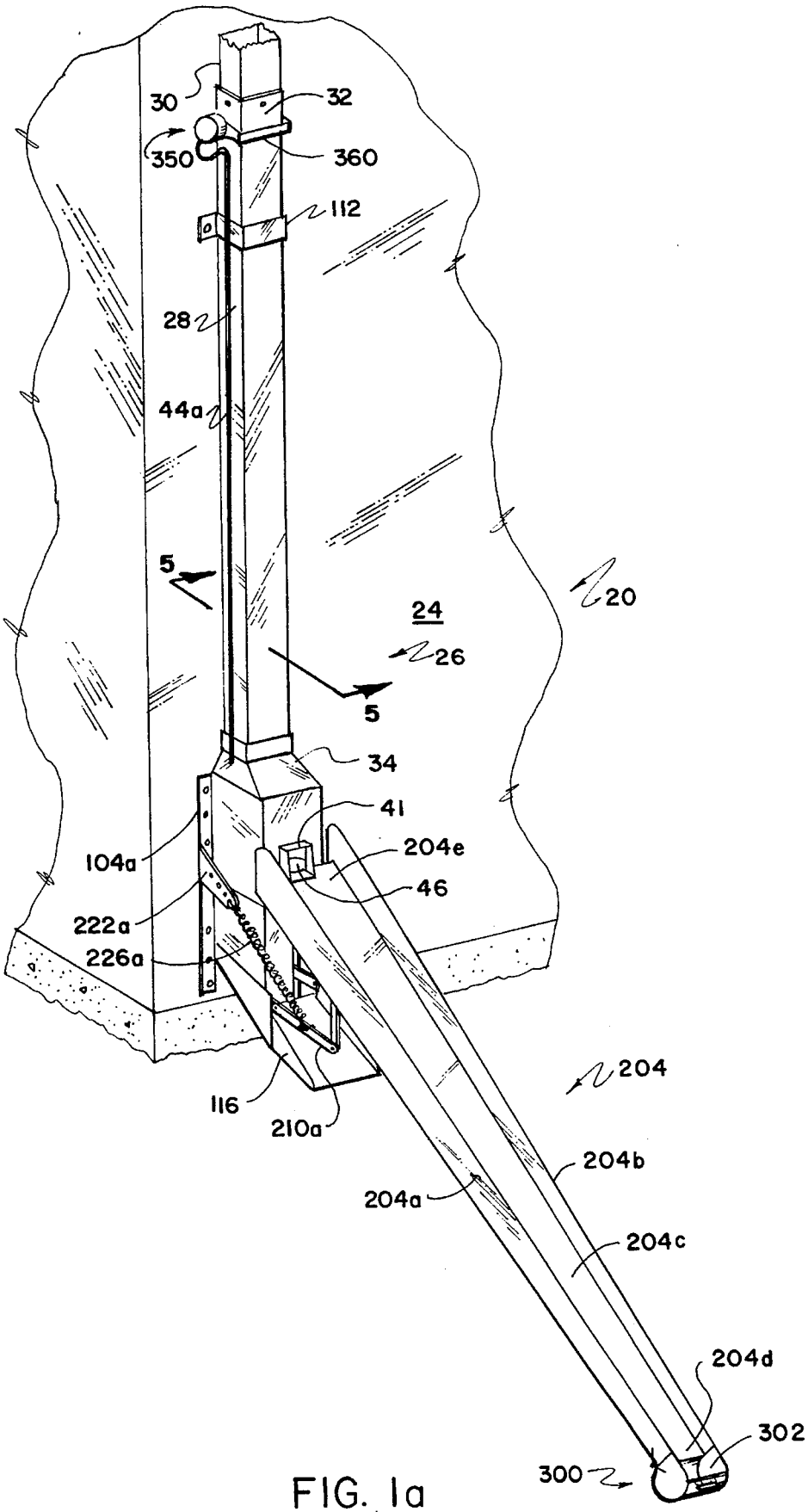
FIG. 1*a* shows a perspective view of the entire apparatus installed on a building wall with the trough in its lower position.

My invention is an apparatus 20 for conveying water from a rain gutter 22 to a point remote from a building wall 24, the preferred embodiment of which is shown in FIGS. 1*a* through 5*c* and FIGS. 6*a* through 9*b*. The preferred embodiment comprises a frame 26, having a generally rectangular frame upper section 28, the top of which is connected to the rain gutter discharge 30 as shown in FIG. 1*a*, using a slip fit connection 32 wherein a portion of the rain gutter discharge 30 is closely received by the frame upper section 28. The frame upper section 28 is similar to an ordinary downspout and performs the same function. It can made of a variety of plastics or metals.

Figure 2:
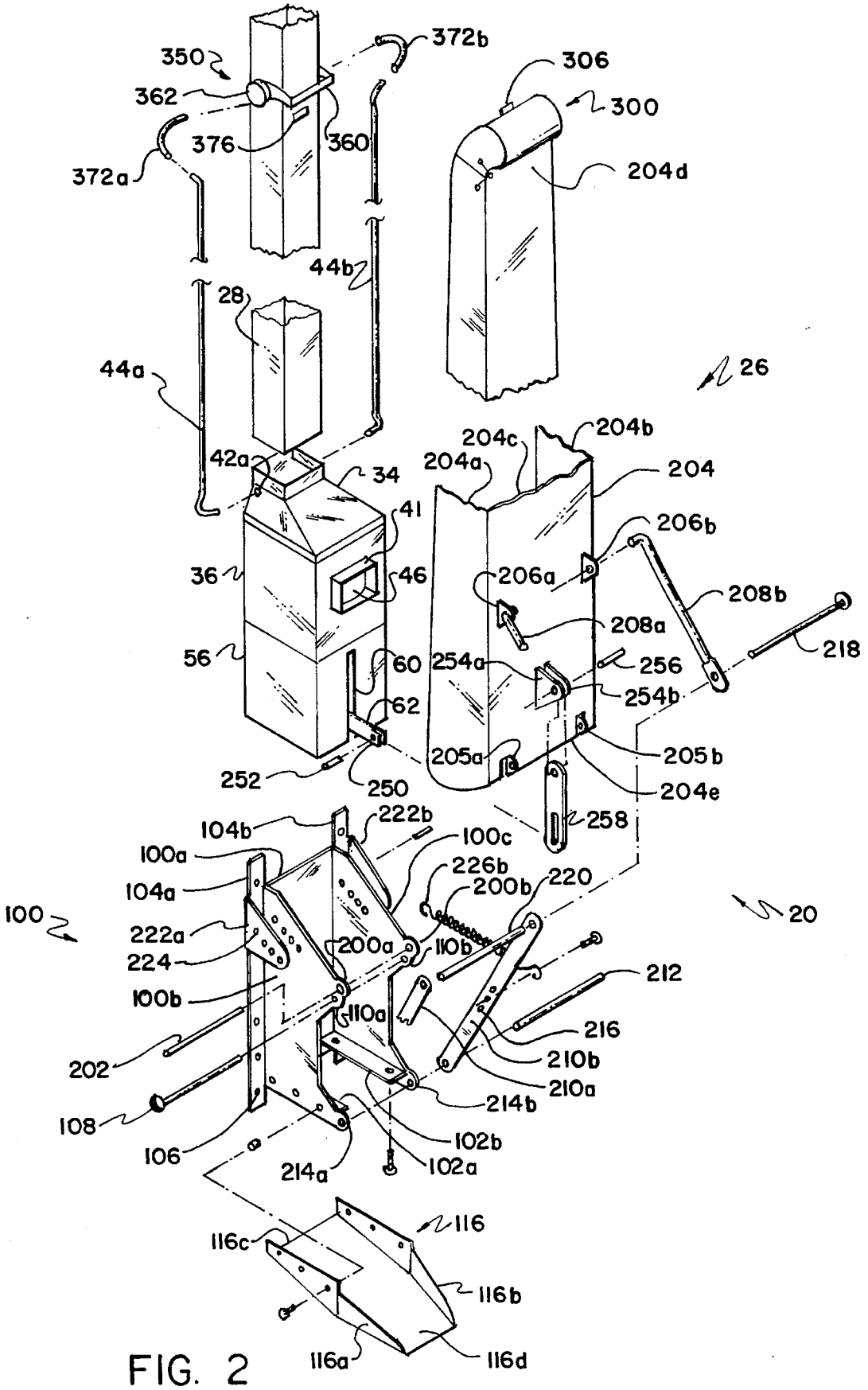
FIG. 2 shows an exploded view of the entire apparatus.
Figure 4:
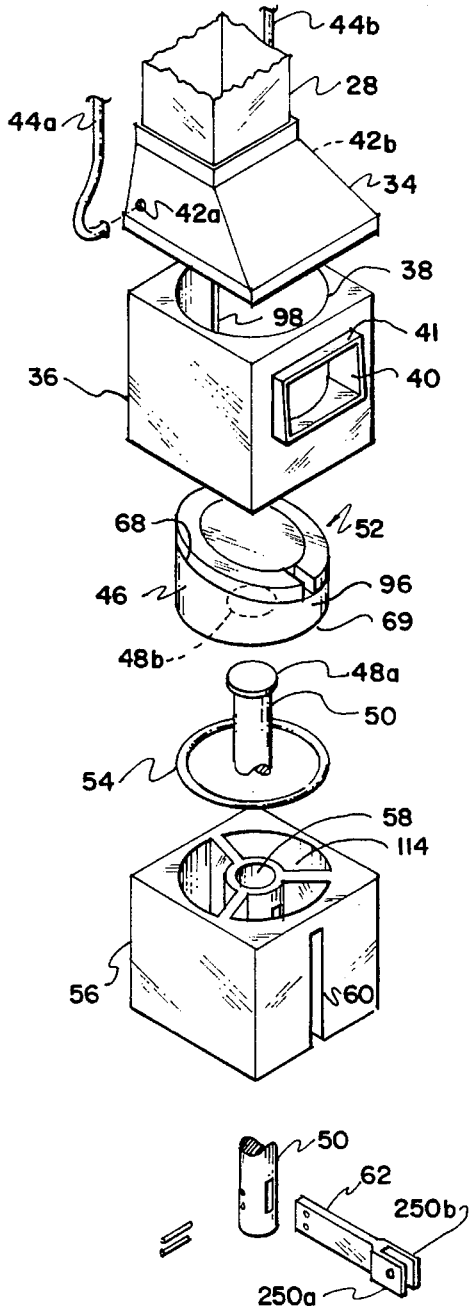
FIG. 4 shows an exploded view of the interior of the frame cylinder section and the frame lower body section.
Figure 5B:
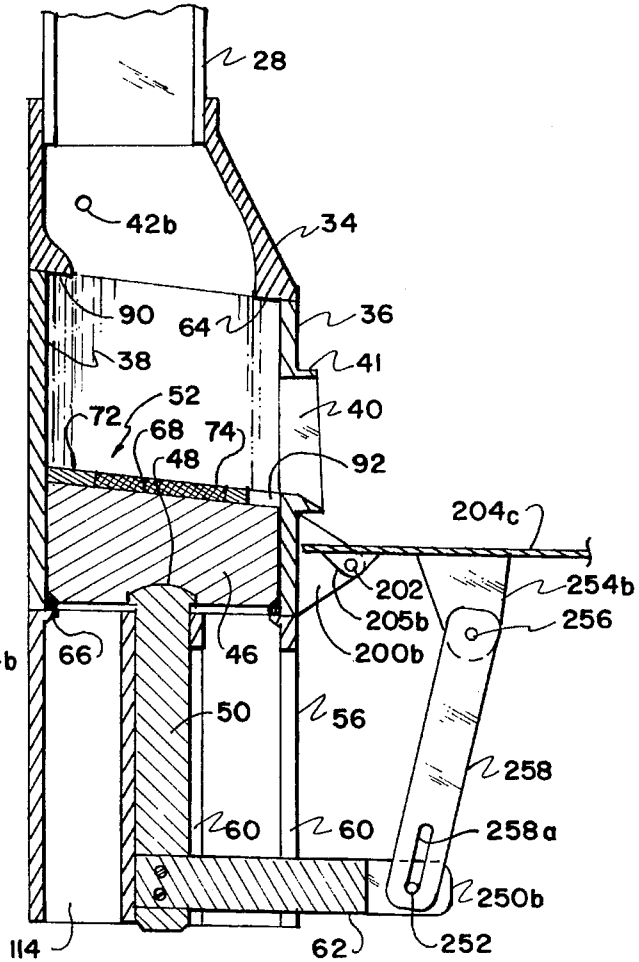
FIGS. 5*a–c* show three sectional side views of the frame transition section, the frame cylinder section, and the frame lower body section, the trough being depicted in its upper, intermediate, and lower positions, respectively. All views reference cutting plane line 5—5 on FIGS. 1*a–b*.
Figure 5C:
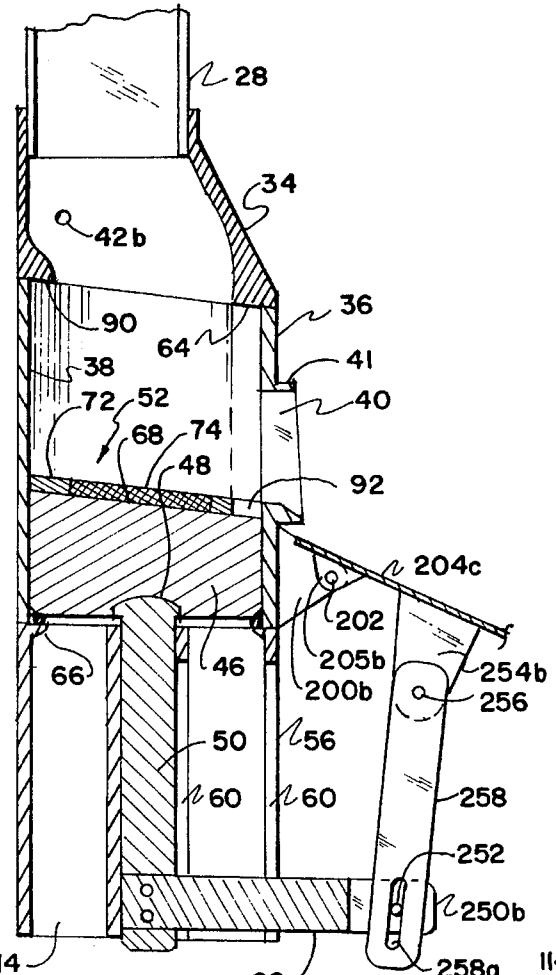
Figure 5A:
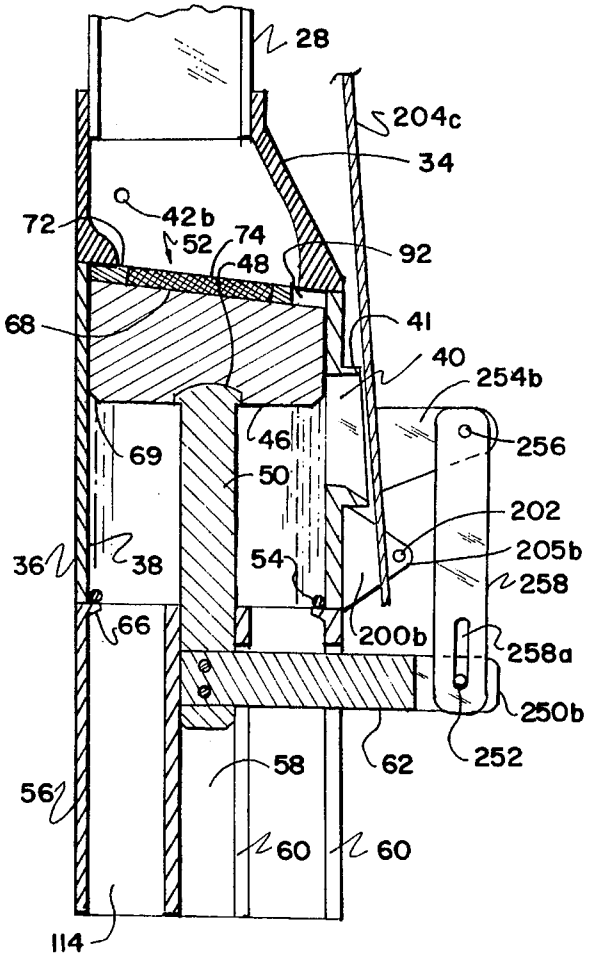

The frame upper section 28 extends downwardly until reaching a transition point at which the cross sectional area increases through the use of a frame transition section 34 as shown in FIGS. 1*a*, 4*a* and 5*a*. This frame transition section 34 is attached to a frame cylinder section 36 which has a vertically oriented cylinder 38, a cylinder outlet port 40, and a cylinder outlet port chute 41 as shown in FIGS. 1*a*, 4*a* and 5*a*. The frame transition section 34 also has a pair of small holes 42*a–b* located on opposite sides of the frame transition section 34. The frame transition section holes 42*a–b* closely receive and secure the lower ends of a pair of rigid tubes 44*a–b* which extend upwardly along the frame upper section 28, as shown in FIG. 2. Within the frame cylinder section 36 is a piston 46, a ball and socket joint 48*a–b*, the upper portion of the piston rod 50, a piston upper seal ring 52, and a piston lower seal ring 54, as shown in FIGS. 4*a–b* and 5*a*.

Attached to the frame cylinder section 36 is the frame lower body section 56 as shown in FIGS. 4*a* and 5*a–c*. A vertical piston rod guide 58 is centrally located for receiving and allowing vertical movement of the piston rod 50 as the lower portion of the piston rod 50 extends vertically from the frame cylinder section 36. A vertical slot 60 is provided in the frame lower body section 56 on a side which corresponds with the side of the frame cylinder section 36 containing the cylinder outlet port 40. Perpendicularly attached to the piston rod 50 is a control arm 62 which is sized to extend from the piston rod 50 and through the vertical slot 60, the vertical slot 60 being wide enough and long enough to allow the control arm 62 to move vertically over the entire length of piston 46 travel.

The frame transition section 34 has at its lower end and adjacent the upper end of the cylinder 38, a radially shaped shoulder, which forms an upper cylinder piston seat 64, as shown in FIG. 5*a*. At the upper end of the frame lower body section 56 is a radially shaped shoulder which forms a lower cylinder piston seat 66.

The piston top 68 is slanted toward the cylinder outlet port 40 as shown in FIG. 5*a*. The piston bottom 69 is beveled.

The piston lower seal ring 54 is an O-ring type shaped to conform to the perimeter of the cylinder 38 and is positioned on the lower cylinder piston seat 66 to form a water seal when borne upon by the piston 46, i.e. when the piston 46 is in its lower position, as shown in FIG. 5*b*. The piston lower seal ring 54 has an opening to allow the piston rod 50 to move freely. The piston lower seal ring 54 is made of rubber although any one of several resilient materials would perform adequately.

Figure 8A:
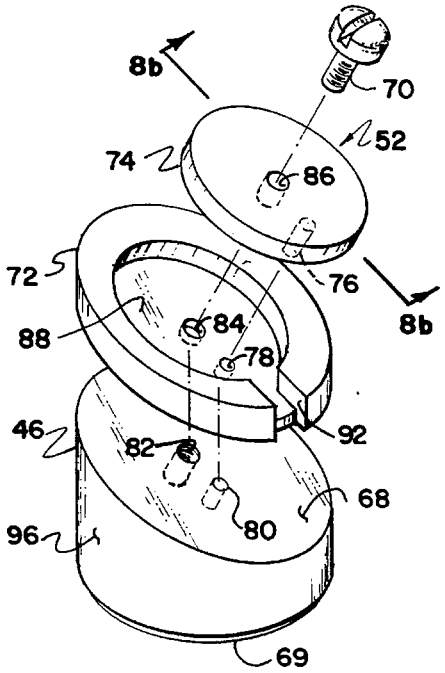
FIGS. 8*a–b* show an exploded and a sectional side view of the piston upper seal ring, respectively.
Figure 8B:
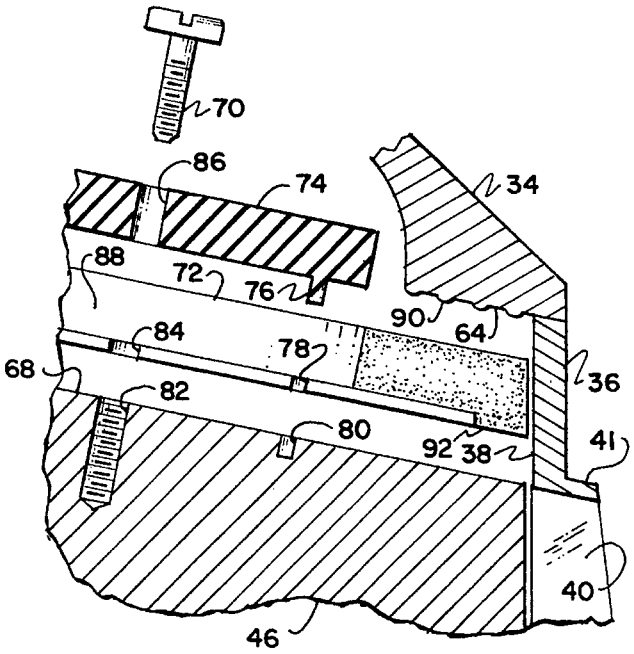

In FIGS. 8*a–b*, the piston upper seal ring 52 used in the preferred embodiment comprises an piston upper seal ring screw 70, a flexible bottom portion 72 and a rigid top portion 74, the top portion 74 having a downwardly projecting alignment pin 76 which is closely received by aligned holes 78,80 in the bottom portion 72 and the piston top 68. The piston top 68 also has a threaded screw hole 82, which accepts the piston upper seal ring screw 70, and which aligns with screw holes 84 and 86 in the bottom portion 72 and the top portion 74, respectively. The top portion 74 is closely received by a recess 88 in the bottom portion 72. The bottom portion 72 is shaped to conform to the perimeter of the cylinder 38 and is attached to the piston top 68 by using the piston upper seal ring screw 70 and the top portion 74, the two of which act as a retainer for the bottom portion 72. Four radial ridges 90 extend downwardly from the upper cylinder piston seat 64. This combination of piston upper seal ring 52 features forms a partial water seal when the piston upper seal ring bottom portion 72 bears upon the upper cylinder piston seat 64, i.e. when the piston. 46 is in its upper position, as shown in FIG. 5*a*. The seal is partial, i.e. allowing slow drainage, because the bottom portion 72 has a channel 92 which allows slow water drainage onto the piston top 68. The amount of such drainage is insignificant during a significant rainfall and will not prevent sufficient volumes of water from accumulating on the piston top 68 as are needed to overcome the trough bias means and to initiate the trough release mechanism 350, as discussed below.

The piston upper seal ring bottom portion 72 and the piston lower seal ring 54 can be made of many resilient materials, including rubber, as is used in the preferred embodiment.

In the preferred embodiment the size of the cylinder outlet port 40 is such that the piston upper seal ring 52 components and the piston lower seal ring 54 may be removed from the frame for service or replacement.

Figure 9A:
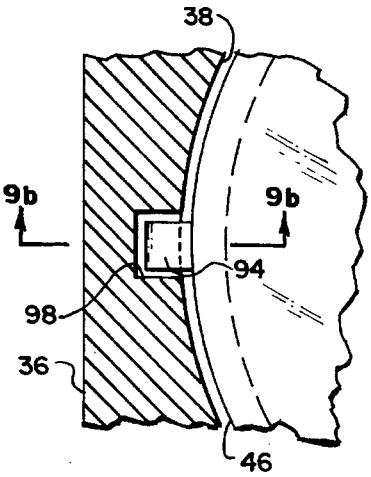
FIG. 9*a* shows a partial plan view of the cylinder, piston, piston key and cylinder key slot.
Figure 9B:
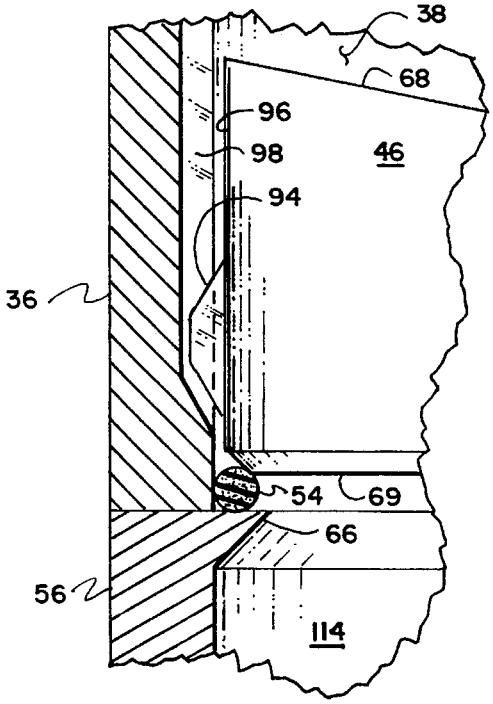
FIG. 9*b* shows a partial sectional side view of the cylinder, piston, piston key and cylinder key slot.

Anti-rotational means are provided to prevent the piston 46 from rotating about the longitudinal axis of the cylinder 38. As shown in FIGS. 9*a–b*. This comprises a piston key 94 on the piston skirt 96 which is closely received by a cylinder key slot 98 allowing movement of the piston key 94 within the cylinder key slot 98, but preventing any piston 46 motion about the longitudinal axis of the cylinder 38.

Although a circular piston 46 and cylinder 38 are used in the preferred embodiment it is very apparent that other cross-sectional shapes for the piston 46 and cylinder 38 would perform adequately. Accordingly, in this application all references to terms such as "piston," "cylinder," "annulus," "ring," "radial," and "seat," as well as any other terms which might ordinarily suggest a circular configuration for the piston 46 and cylinder 38, shall be deemed to include all shapes. In an embodiment with a non-circular piston, it is clear that the anti-rotational means would be automatically provided by the non-circular cylinder.

Support means are provided by ordinary downspout attachment brackets, as well as, an integral frame support bracket 100, as shown in FIG. 2. The frame support bracket 100 has three sides 100*a–c*, and is shaped for closely receiving the frame lower body section 56 and the frame cylinder section 36. Each of the parallel sides 100*b–c* have perpendicular shoulders 102*a–b* attached such that the frame lower body section 56 rests upon and is positioned for attachment to the shoulders 102*a–b*. A pair of flared strips 104*a–b* extend perpendicularly from the parallel frame support bracket sides 100*b–c* such that the strips 104*a–b* are flush with the back side 100*a* of the frame support bracket 100. Each of the strips 104*a–b* have holes 106 for use in attachment to the building wall 24. Forward movement of the frame 26 from the frame support bracket 100 is prevented by a retention pin 108 the ends of which are closely received by holes 110*a–b* in the parallel sides 100*b–c*. Further support means is provided by ordinary downspout attachment brackets 112, as shown in FIG. 1*a*.

Figure 1B:
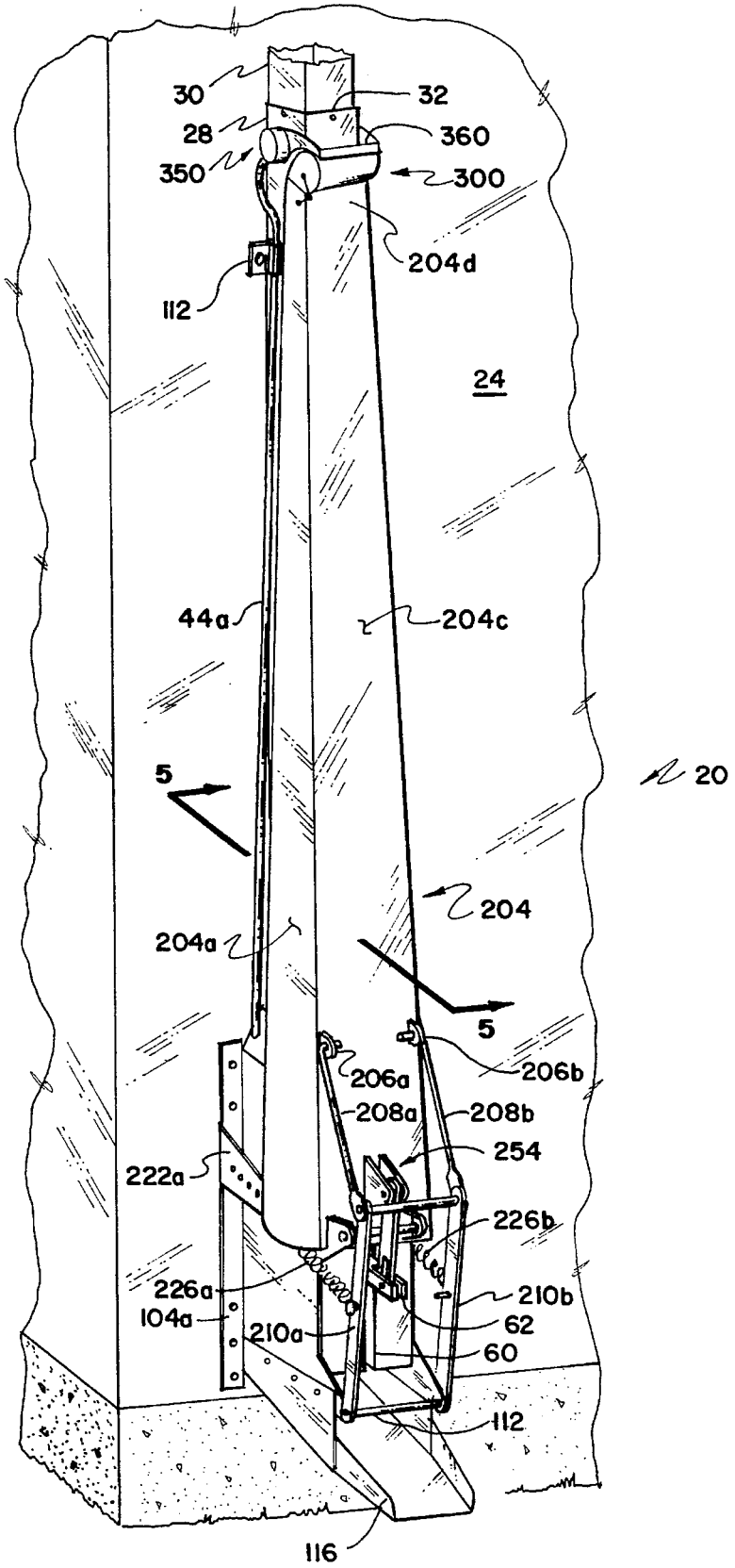
FIG. 1*b* shows a perspective view of the entire apparatus installed on a building wall with the trough in its upper position.

The frame lower body section 56 is open ended at the bottom as shown in FIGS. 5*a–c*. Water exiting from the bottom opening 114 is caught by a drainage diverter pan 116 which is attached to the frame support bracket 100 as shown in FIGS. 1*b* and 2. The pan has two sides 116*a–b*, a discharge chute 116*c*, and a bottom 116*d* which is sloped toward and is part of the discharge chute 116*c*.

As shown in FIGS. 2 and 5*a*, a first pair of trough pivot pin braces 200*a–b* extends from the parallel sides 100*b–c* of the frame support bracket 100 and holds a trough pivot pin 202 in a position beneath and parallel to the cylinder outlet port 40. A trough 204 is attached to the trough pivot pin 202 through a second pair of trough pivot pin braces 205*a–b*, the attachment point being near the end of the trough 204*e* such that the trough 204 can pivot freely. The trough 204, frame 26 and frame support bracket 100 are shaped such that the trough sides 204*a–b*, and bottom 204*c* encompass the majority of the frame 26 and frame support bracket 100 when the trough 204 is in its upper position and leaning against the frame 26, as shown in FIG. 1*b*. The trough 294 has a trough remote end 204*d* through which water is discharged.

The trough pivot pin braces 200*a–b* hold the trough pivot pin 202 a sufficient distance from the frame 26, such that when the trough 204 is in its upper position, the center of gravity of the trough 204 is disposed slightly closer to the frame than when the trough 204 is in a vertical position, as shown in FIG. 5*a*. The lean of the trough 204 acts as a trough bias means.

Figure 3:
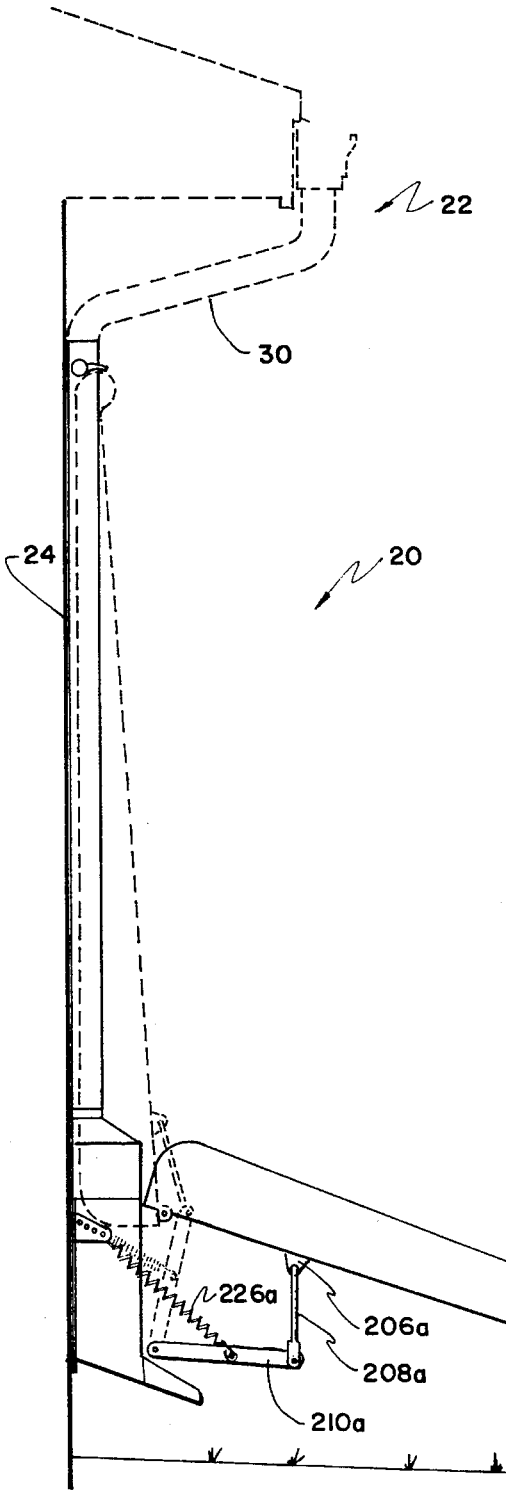
FIG. 3 shows a generalized side view depicting the motion of the springs and trough return members in relation to the trough.

A pair of trough braces 206*a–b* extends from the bottom 204*c* of the trough 204, as shown in FIGS. 2 and 3. Each of the first ends of upper trough return members 208*a–b* is pivotally attached to a trough brace 206*a–b*. The first ends of lower trough return members 210*a–b* are pivotally attached to the ends of a lower trough return member pivot pin 212, the lower trough return member pivot pin 212 being held in place by lower trough return member pivot pin braces 214*a–b*, each of which extends from the lower part of the frame support bracket 100. The lower trough return members 210*a–b* each have several holes 216 along their length. The second ends of the upper trough return members 208*a–b* and the second ends of the lower trough return members 210*a–b* are pivotally connected to the ends of an upper trough return member pivot pin 218. An upper trough return member pivot pin spacer is provided 220.

Spring frame attachment braces 222*a–b* are attached to the frame support bracket 100 as shown in FIGS. 1*a* and 2, each of the braces having several holes 224 each. As shown in FIG. 3, the first and second ends of a pair of cylindrical, helical springs 226*a–b* are attached to the spring frame attachment holes 224 and the lower trough return member holes 216, respectively. The springs 226*a–b* act as trough bias means and are in tension for all positions of the trough 204, the tension being adjustable by choosing various combinations of spring frame attachment holes 224 and lower trough return member holes 216. In the preferred embodiment the trough 204 rests upon the ground while in its lower position, as shown in FIG. 3.

FIGS. 2, 4 and 5*a* depict a first pair of connecting pin braces 250*a–b* which extend froth the control arm 62 and hold a first connecting pin 252 in a position below and parallel to both the trough pivot pin 202 and the trough bottom 204*c*. A second pair of connecting pin braces 254*a–b* extends from the trough bottom 204*c* and hold a second connecting pin 256 in a position above and parallel to both the trough pivot pin 202 and the trough bottom 204*c*. The second end of linkage bar 258 is pivotally attached to the second connecting pin 256. The first end of the linkage bar 258 is attached to the first connecting pin 252, the attachment comprising a linkage bar slot 258*a* which receives the first connecting pin 252. The linkage bar slot 258*a* is sized to allow movement of the connecting pin 252 between the two ends of the linkage bar slot 258*a*, this movement allowing a temporary disengagement of the rigid linkage between the trough 204 and the piston 46. In the preferred embodiment's optimum installation, the first connecting pin 252 will be between the ends of the linkage bar slot 258*a* when the trough 204 is in contact with the ground, as shown in FIGS. 3 and 5*c*.

As shown in FIGS. 1*a*, 2 and 6*a–c*, a trough stabilizer 300 is provided in the preferred embodiment. It includes a somewhat cylindrically shaped water collection reservoir 302, located at the trough remote end 204*d* and situated parallel to the trough pivot pin 202. A portion of the top of the water collection reservoir 302 is removed allowing water to accumulate in the water collection reservoir 302 as it is discharged from the trough remote end 204*d*. A number of small drain holes 304 are located on the sides of the water collection reservoir 302 and are sized and located such that substantially all water will slowly drain from the water collection reservoir 302. The water collection reservoir 302 is sized such that it will overcome the return bias force of the springs 226*a–b* when it is substantially full of water. A rectangular tab 306 is attached to and extends outwardly from the water collection reservoir 302 parallel to the longitudinal axis of the trough 204.

Figure 6A:
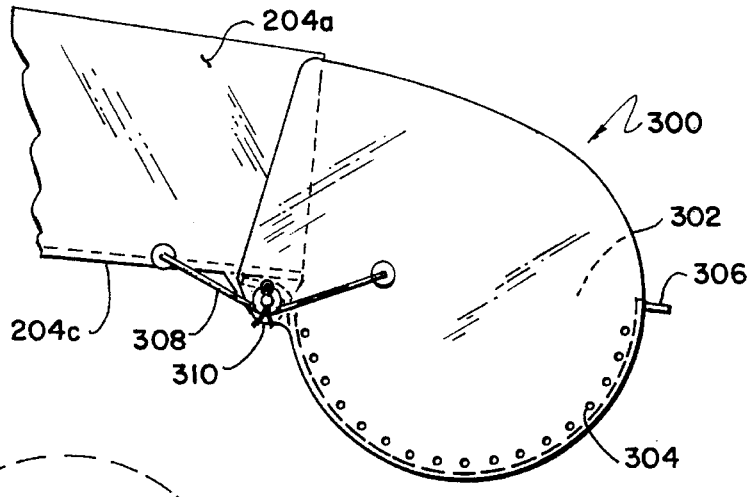
FIGS. 6*a–b* shows two side views of the trough stabilizer and shock absorber means, the views depicting the motion of the water collection reservoir against the tension spring.
Figure 6B:
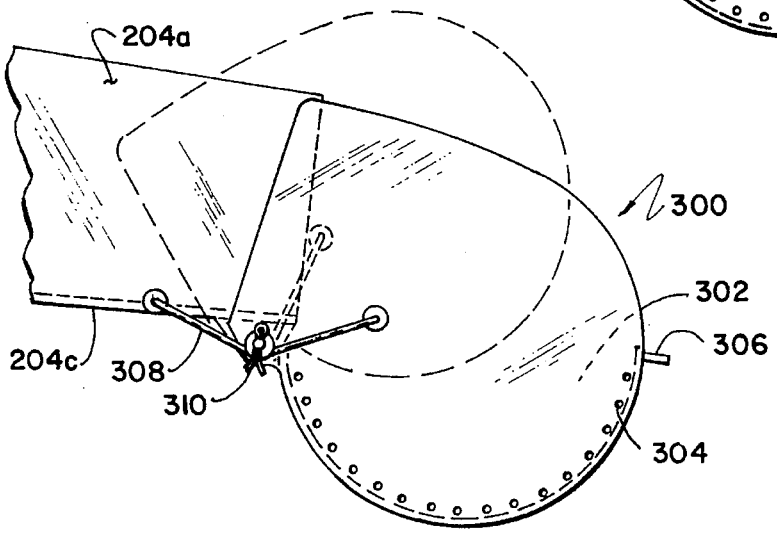
Figure 6C:
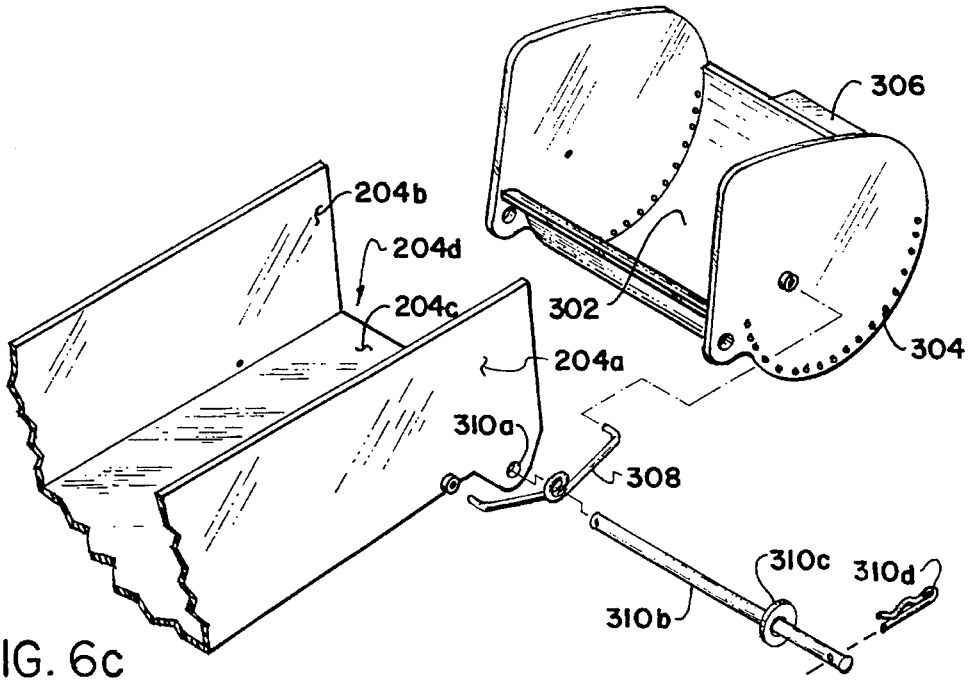
FIG. 6*c* shows an exploded view of the trough stabilizer and shock absorber means.

In FIGS. 6*a–c* a shock absorber means is provided in the preferred embodiment which includes a tension spring 308 and a hinge connection 310*a–d* between the water collection reservoir 302 and the trough remote end 204*d*, the hinge connection 310*a–d* allowing rotation of the trough stabilizer 300 about an axis parallel to the trough pivot pin 202. The tension spring 308 is mounted on the hinge connection 310*a–d* with one end attached to the water collection reservoir 302 and the other attached to the trough side 204*a* near the trough remote end 204*d*, the tension spring 308 resisting rotation of the water collection reservoir 302 from a position other than the position shown in FIG. 6*a*.

The preferred embodiment also includes a trough release mechanism 350, located on the frame upper section 28 as shown in FIGS. 1*a–b*, 2 and 7. The trough release mechanism 350 includes a pair of trough release pivot pins 352*a–b*, each attached to an opposite side of the frame upper section 28. Attached to the each trough release pivot pin 352*a–b* is one of a pair of trough release pivoting members 354*a–b*. The pivoting range of the trough release pivoting members 354*a–b* is restricted by an outwardly projecting upper stop 356 and lower stop 358. A latch bar 360 connects the forward ends of the trough release pivoting members 354*a–b*, and is situated parallel to the trough release pivot pins 352*a–b*. A first container 362 is attached at the rear end of the trough release pivoting member 354*a*, with the first container 362 having a vent hole 364 near the top of the first container 362 and a water feed hole 366 and water feed hole nipple 368 located at the bottom. A symmetrically opposite but otherwise identical second container 370 is attached at the rear end of the trough release pivoting member 354*b*. The first ends of two lengths of flexible plastic tubing 372*a–b* are connected to each of the water feed hole nipples 368. The second ends of the tubing 372*a–b* are connected to the top ends of rigid tubing 44*a–b* which descend along the length of the frame upper section 28 until they attach to the frame transition section 24 as discussed above, such that water may flow freely between the frame transition section 34 and the first and second containers 362,370. The size of the first and second containers 362,370 is chosen such that, when the first and second containers 362,370 are empty, the trough release pivoting members 354*a–b* are in a first position wherein the latch bar 360 is down. The size of the first and second containers 362,370 is also chosen such that, when the first and second containers 362,370 are substantially full, the trough release pivoting members 354*a–b* are in a second position wherein the latch bar 360 is up. The tab 306 on the trough stabilizer 300 is positioned such that the tab 306 is parallel to the latch bar 360. The latch bar 360 has a notch 374 centrally located on the inside of the latch bar 360. The notch 374 is parallel to the latch bar 360 and is sized and located such that it will closely receive the tab 306 when the tab 306 is disposed between the latch bar 360 and the frame upper section 28. A small bumper pad 376 is attached to the frame upper section 28 which is borne upon by the inside bottom 204*c* of the trough 204 at the completion of its return to its upper position.

In the preferred embodiment the relative sizes and positions of the first pair of connecting pin braces 250*a–b*, the second pair of connecting pin braces 254*a–b*, the first connecting pin 252, the second connecting pin 256, the linkage bar 258, the linkage bar slot 258*a*, the control arm 62, the piston rod 50, the piston 46, the upper cylinder piston seat 64, the lower cylinder piston seat 66, the cylinder outlet port 40, and the trough 204, are such that the piston 46 bears upon the piston upper seal ring bottom portion 72 when the trough 204 is in its upper position as shown in FIG. 5*a*. As water accumulates above the piston top 68 it will simultaneously rise through the water feed passages formed by the rigid tubing 44*a–b* and flexible tubing 372*a–b*, and fill the first and second trough release containers 362,370 with sufficient water to cause the trough release pivoting members 354*a–b* to move from the first position to the second position and the latch bar 360 to then rise. The head of water on the piston top 68 will by this point be sufficient to overcome the trough bias means and the trough 204 will begin its descent. In the preferred embodiment the cylinder outlet port 40 begins to be exposed prior to the trough 204 completing its descent. As water is entering the trough 204 it adds additional forces tending to move the trough 204 to its final lower position. The linkage bar slot 258*a* is located and sized such that the trough 204 will continue to descend after the piston 46 has seated in the lower cylinder piston seat 66, at which time the piston 46 is no longer exerting a downward force on the trough 204 through the linkage. Completion of the descent is assured by virtue of the water in the trough 204 at the time the trough 204 disengages from its rigid connection to the piston 46. The cylinder outlet port 40 is completely exposed when the trough 204 has completed its descent, allowing full water flow. During such flow the water collection reservoir 302 is continuously being filled from the water discharge, and the weight of the full water collection reservoir 302 alone ensures that the trough 204 will not begin its ascent. When water flow from the rain gutter discharge 30 ceases, the accumulation of water on the piston top 68 is eliminated, the first and second trough release containers 362,370 drain, and the latch bar 360 is lowered. As the last of the water discharges from the trough 204, the water collection reservoir 302 begins to slowly drain its collected water until the spring 226*a–b* return bias force is no longer exceeded, at which time the trough 204 begins its ascent. As the trough 204 ascends the piston 46 is once again engaged by the linkage and the piston 46 is forced upward. When the tab 306 bears upon the latch bar 360 as the trough 204 is completing its ascent, the latch bar 360 is temporarily displaced to allow the tab 306 to pass underneath, at which time the latch bar 360 drops down to secure the trough 204 as the tab 306 is closely received by the latch bar notch 374.

Figure 10A:
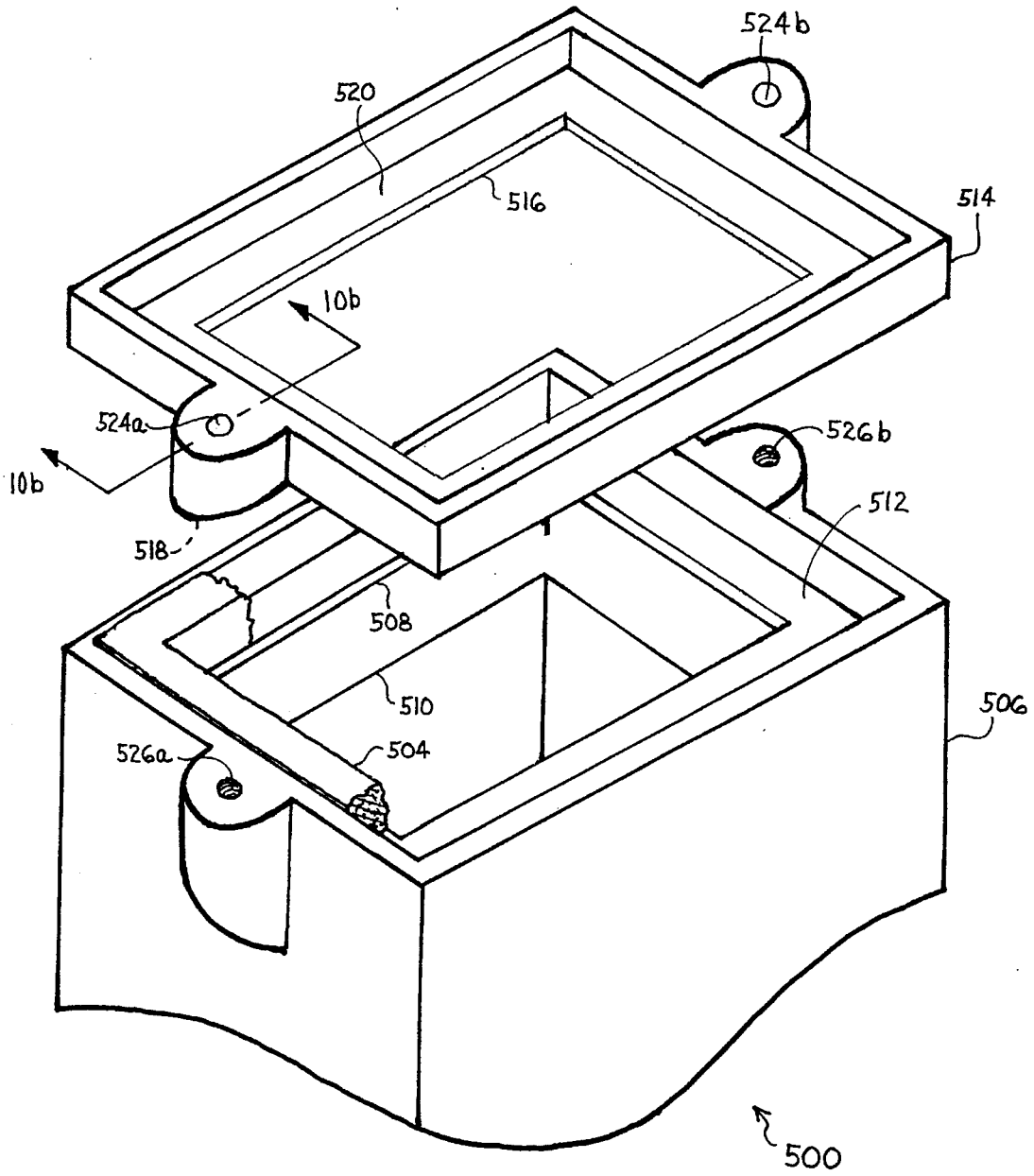
FIG. 10*a* shows an exploded view of the modified frame top, rain gutter discharge seal and seal compressor, all part of an alternative embodiment where an extended portion of the building's existing rain gutter discharge is utilized.
Figure 10B:
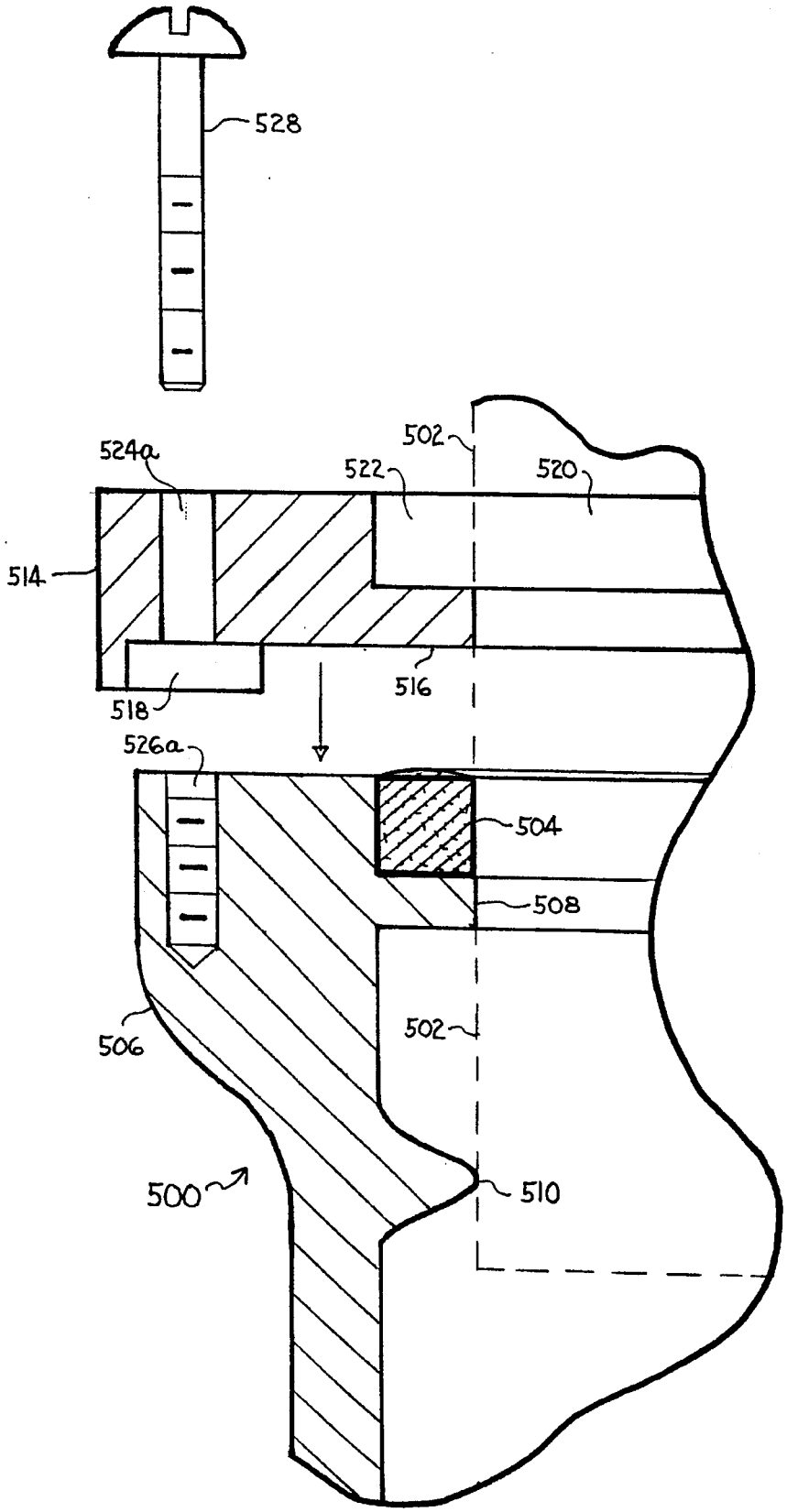
FIG. 10*b* shows a partial sectional view of the modified frame top, rain gutter discharge seal and seal compressor, all part of an alternative embodiment where an extended portion of the building's existing rain gutter discharge is utilized.

An alternative embodiment provides for the utilization of a rain gutter system's existing downward extension of the discharge in place of the upper portions of the frame as previously described herein. FIGS. 10*a–b* show connection means for attaching a modified frame 500 to the existing rain gutter discharge 502 at a point lower than the trough release mechanism 350. A rain gutter discharge seal 504 is sized to closely fit the rain gutter discharge 502. The frame 500 has a modified frame top 506 which has inwardly projecting structures which act as a rain gutter discharge upper positioner 508 and lower positioner 510, respectively. The upper positioner 508 and lower positioner 510 are shaped to allow passage of the end of the rain gutter discharge 502 and to maintain the rain gutter discharge 502 in a substantially vertical position. A frame top recess 512 is formed by the placement of the upper positioner 508 near, but beneath the top of the modified frame top 506, the frame top recess 512 being sized to closely receive the rain gutter discharge seal 504 when the rain gutter discharge 502 is inserted into the modified frame top 506. When the rain gutter discharge 502 is so inserted the rain gutter discharge seal 504 bears upon the upper positioner 508, as shown in FIG. 10*b*.

The rain gutter discharge seal 504 is slightly oversized with respect to the frame top recess 512 such that a portion of the rain gutter discharge seal 504 protrudes above the modified frame top 506 until compressed by a rain gutter discharge seal compressor 514. The rain gutter discharge seal compressor 514 has an inwardly projecting rain gutter discharge positioner 516 which is shaped to closely receive the rain gutter discharge 502. The seal compressor 514 also has a bottom recess 518 which is shaped for closely receiving the modified frame top 506, and a top recess 520 shaped such that a trench 522 is formed between the seal compressor 514 and the rain gutter discharge 502. The seal compressor 514 has a pair of screw holes 524*a–b* and the modified frame top 506 has a pair of threaded screw holes 526*a–b*, each of the corresponding pairs being positioned and sized to receive a connecting screw 528. When the connecting screws 528 are tightened the seal compressor 514 bears upon the modified frame top 506 and the protruding portion of the rain gutter discharge seal 504, causing the seal 504 to bear against the sides of the rain gutter discharge 502 forming a water seal. Additional sealing capability can be achieved by placing common sealant material in the trench 522.

Figure 11:
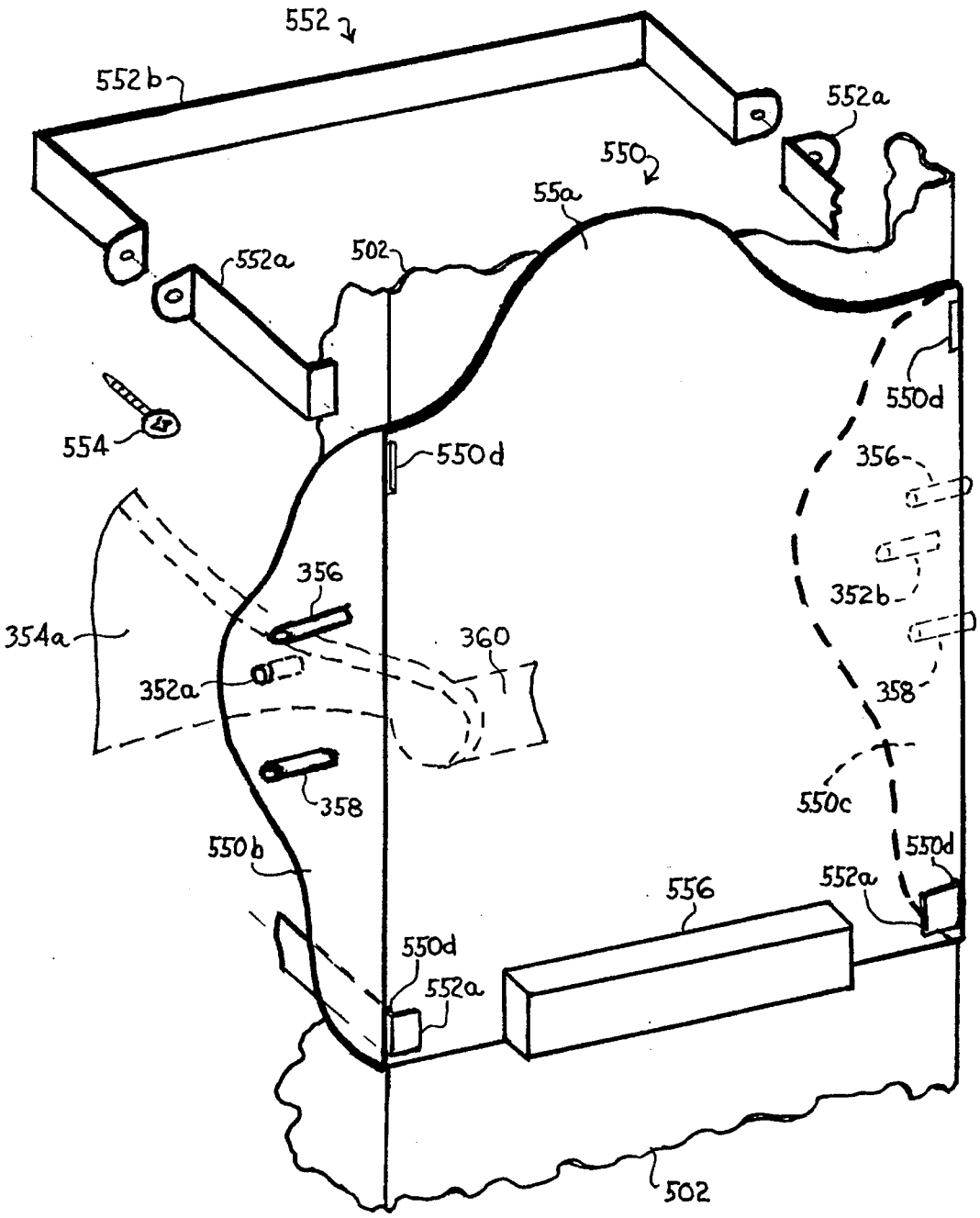
FIG. 11 shows an exploded view of the trough release mechanism attachment hardware which is used in an alternative embodiment where an extended portion of the building's existing rain gutter discharge is utilized.
Figure 10A:
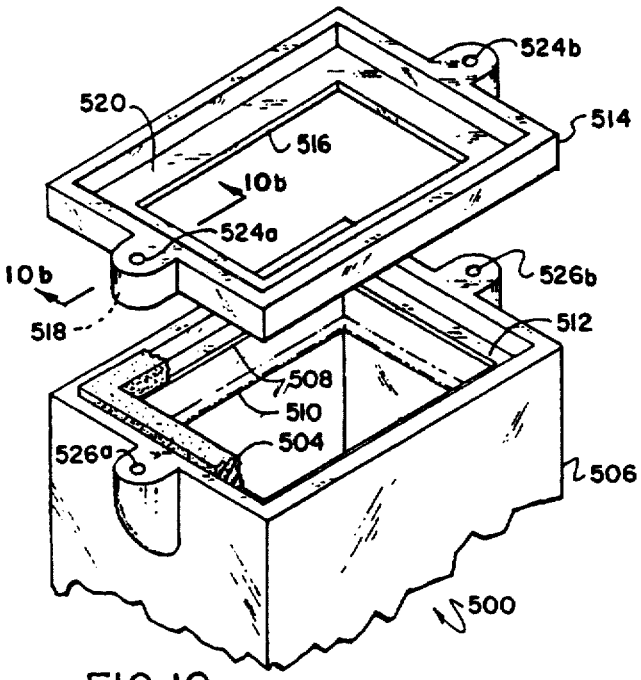
Figure 10B:
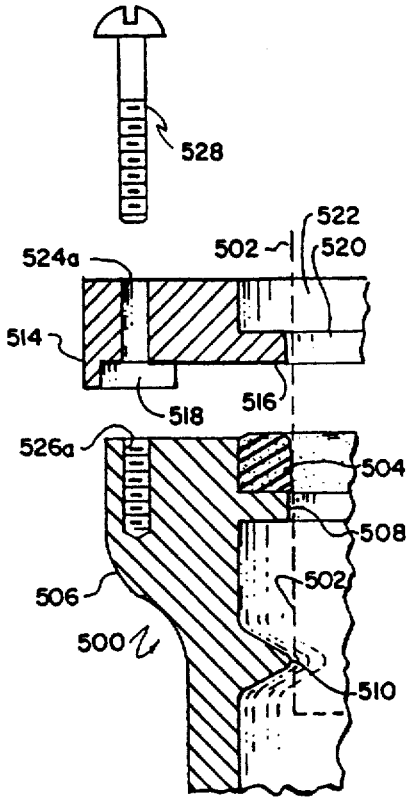
Figure 11:
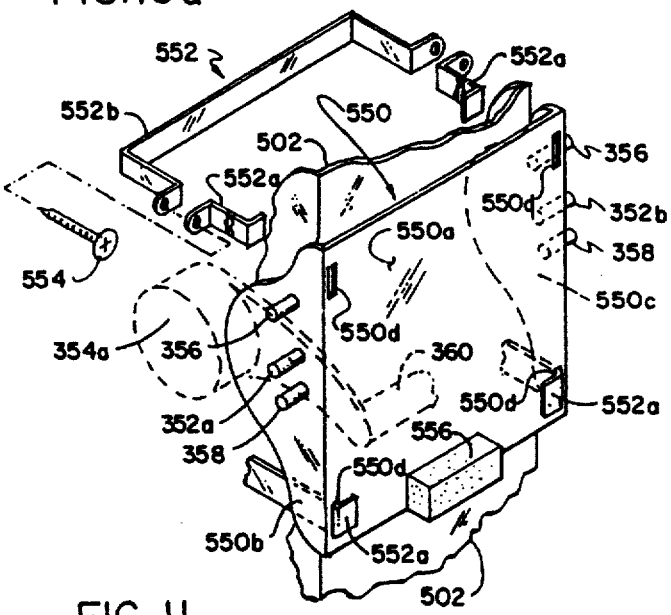

In this alternative embodiment, where the frame 500 is attached to the rain gutter discharge 502 at a point lower than the trough release mechanism 350, a means for attaching the trough release mechanism 350 to the rain gutter discharge 502 is provided, as shown in FIG. 11. A bracket portion 550 has a front 550*a* and two parallel sides 550*b–c*, the sides 550*b–c* being spaced for closely receiving the existing rain gutter discharge 502. Each of a pair of three piece clamps 552 has two front pieces 552*a* which are bent for insertion into four slots 550*d* in the front portion 550*a* of the bracket 550. Each of the clamp front pieces 552*a* are joined to the respective rear pieces 552*b* by clamp screws 554, the assembled clamps 552 being shaped to surround and grasp the rain gutter discharge 502. The bracket sides 550*b* also serve as modified trough release pivot pin braces which hold the trough release pivot pins 352*a–b*, the upper pivot stop 356 and the lower pivot stop 358, as previously described. A rubber bumper pad 556 is provided on the front 550*a* of the bracket 550.

Shock absorber means can be enhanced by including one or more additional springs, or by using devices with variable spring constants, to supplement the spring return bias force as the trough components approach impact with the ground. Experiments with ordinary twine attached such that it becomes taut near the trough-ground impact point have to some extent shown the potential of such enhancement alternatives.

Figure 5D:
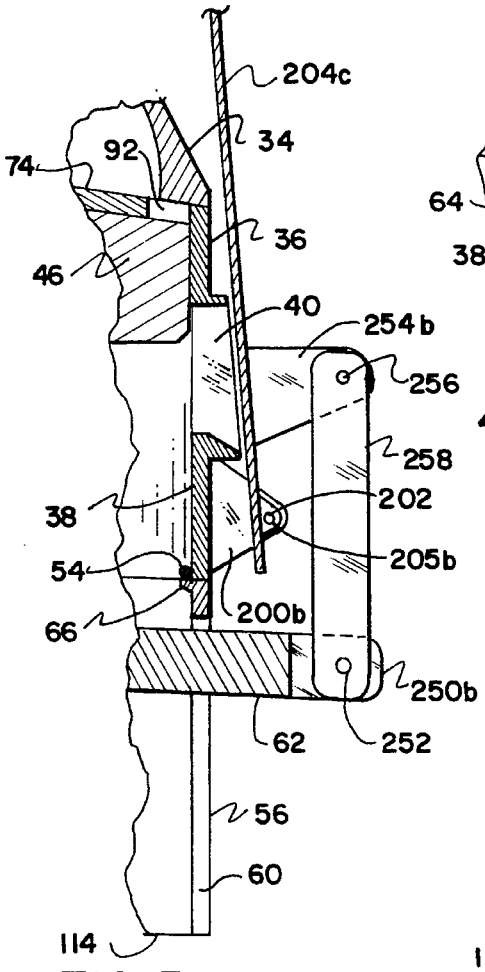
FIGS. 5*d–e* show two partial sectional side views of the frame transition section, the frame cylinder section, and the frame lower body section, in an alternative embodiment where the disengagement joint is removed from the piston-trough linkage, i.e. the linkage bar slot is removed. The trough is depicted in its upper and lower positions, respectively. All views reference cutting plane line 5—5 on FIGS. 1*a–b*.
Figure 5E:
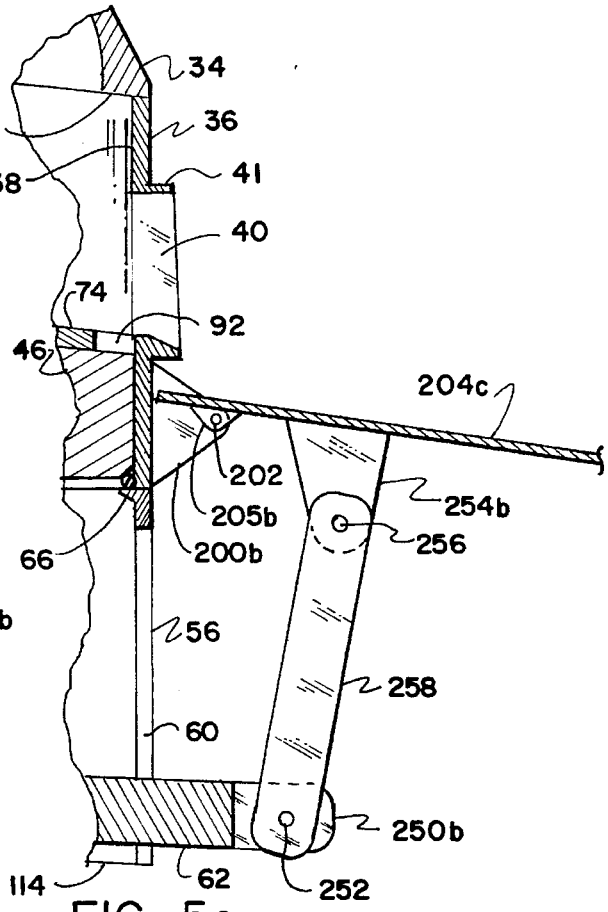
Figure 7:
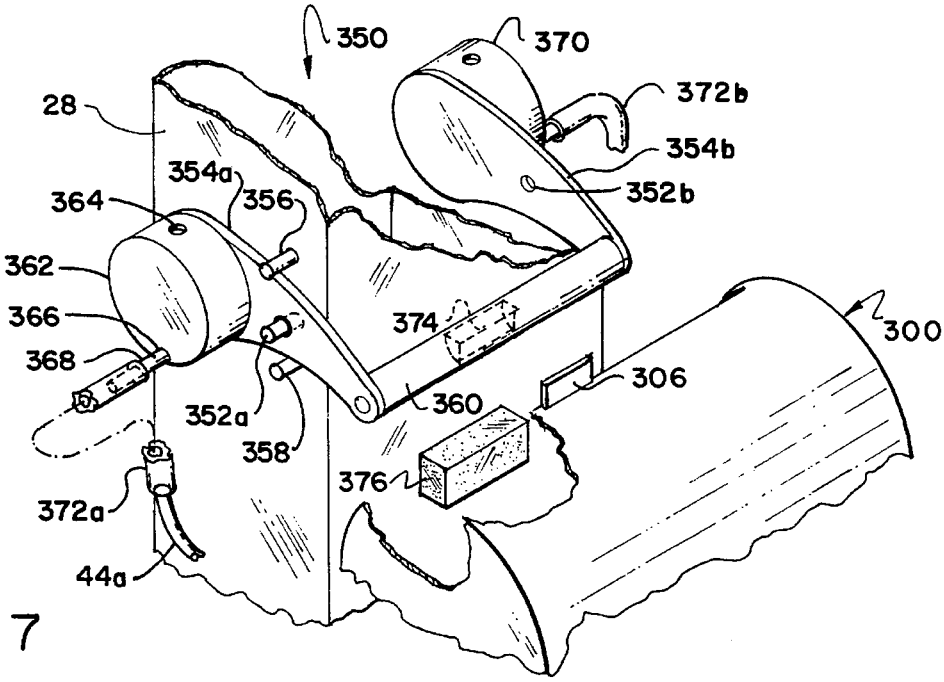
FIG. 7 shows a perspective view of the trough release mechanism.

Additional alternative embodiments would clearly include the more elementary configurations of the apparatus. In FIGS. 5*d–e* the linkage bar slot 258*b* is removed, which rigidly connects the piston 46 and the trough 204 during the entire travel of both. Alternatively, an apparatus could utilize the leaning trough 204 as the sole trough bias means. The claims herein are capable of many combinations and nothing in this Description is intended as a limitation on the scope of such claims in their present form or as amended.

I claim:

1. An apparatus for conveying water from a rain gutter to a point remote from a building wall, which comprises:

(a) a piston having a top;

(b) a frame, the frame having a cylinder for closely receiving the piston and allowing movement of the piston between an upper position and a lower position, the frame further having a cylinder outlet port, the frame further having a water passage for receiving and transporting water such that the water accumulates and bears upon the piston top while the piston is in its upper position;

(c) a trough, the trough having a near end and a remote end, the trough being pivotally attached to the frame for movement between an upper position and a lower position, the trough being attached and oriented such that it receives water from the cylinder outlet port into the trough near end when the trough is in its lower position, the trough being further attached and oriented such that the water drains from the trough near end to the trough remote end when the trough is in its lower position;

(d) trough bias means for biasing the trough to remain in its upper position; and (e) a linkage for linking the piston to the trough, the linkage being oriented such that the trough bias means causes a force on the piston in opposition to the force exerted by the water bearing upon the piston, and further such that the piston remains in its upper position until the water force exceeds the trough bias means force, the linkage being further oriented such that downward movement of the piston from its upper position causes downward movement of the trough from its upper position.

2. The apparatus of claim 1, further comprising connection means for receiving water into the frame water passage from the rain gutter discharge, the connection means comprising the frame, the frame having a frame top, the frame top being sized to closely receive the rain gutter discharge.

3. The apparatus of claim 1 further comprising support means for supporting the apparatus.

4. The apparatus of claim 3 wherein the support means comprises the frame, the frame having a frame support strip, the frame support strip having a fastener hole, the frame support strip being positioned on the frame such that the frame support strip and the frame support strip fastener hole are adjacent the building wall.

5. The apparatus of claim 1 wherein the linkage is further oriented such that the piston is in its upper position when the trough is in its upper position, and the piston is in its lower position when the trough is in its lower position.

6. The apparatus of claim 1 wherein the linkage further comprises a disengagement joint, the linkage and disengagement joint being oriented such that the trough descends from an intermediate position to its lower position while disengaged from a rigid connection to the piston, the linkage and disengagement joint being further oriented such that when the trough ascends from its lower position to an intermediate position the linkage between the piston and the trough becomes a rigid connection and remains a rigid connection while the trough ascends from such intermediate position to its upper position.

7. The apparatus of claim 6 wherein the linkage and disengagement joint are further oriented in relation to the location of the cylinder outlet port such that water begins to enter the trough from the cylinder outlet port while the trough is in an intermediate position during its descent, and further such that the trough continues its descent to its lower position.

8. The apparatus of claim 1 wherein the linkage is further oriented in relation to the location of the cylinder outlet port such that water begins to enter the trough from the cylinder outlet port while the trough is in an intermediate position during its descent.

9. The apparatus of claim 1 wherein the linkage is further sized and oriented such that the trough is substantially horizontal to the ground when the trough is in its lower position.

10. The apparatus of claim 1 further comprising a cylinder outlet port chute positioned to receive water from the cylinder outlet port and deliver water to the trough near end.

11. The apparatus of claim 1 further comprising:

(a) the piston also having a bottom; and (b) piston lower seal means, the piston lower seal means comprising a lower cylinder piston seat and a lower piston seal ring, the lower piston seal ring having an opening, the lower piston seal ring opening being sized to allow passage and free movement of the linkage, the lower piston seal ring being positioned on the lower cylinder piston seat such that water flow through the lower cylinder piston seat ceases when the lower piston seal ring is borne upon by the piston bottom.

12. The apparatus of claim 11 wherein the linkage further comprises floating piston means such that the piston bears upon but is not rigidly attached to the linkage.

13. The apparatus of claim 12 wherein the cylinder outlet port is positioned such that the lower piston seal ring may be removed through the cylinder outlet port when the linkage is disengaged from the piston.

14. The apparatus of claim 12 wherein the floating piston means comprises:

(a) the piston further having a bottom, the piston bottom having a socket; and (b) a piston rod, the piston rod having an upper end, the piston rod upper end having a ball, the ball being sized and oriented to be closely received by the socket, such that the piston bears upon the ball.

15. The apparatus of claim 1 further comprising piston upper seal means, the piston upper seal means comprising an upper cylinder piston seat and an piston upper seal ring, the piston upper seal ring being positioned on the piston top such that water flow between the piston and the cylinder ceases when the piston upper seal ring bears upon the upper cylinder piston seat.

16. The apparatus of claim 15, further comprising light rain diversion means.

17. The apparatus of claim 16, further comprising:

(a) the frame also having a bottom end, the frame bottom end having an opening; and (b) the light rain diversion means comprising the piston upper seal ring having a channel, the channel being positioned on the piston upper seal ring such that water above the piston upper seal ring slowly drains through the channel onto the piston top, the piston and the cylinder being sized such that water slowly drains from the piston top through the cylinder and through the frame bottom end opening when the piston is in its upper position.

18. The apparatus of claim 17, further comprising a drainage diverter, the drainage diverter being attached to the frame bottom end, the drainage diverter being positioned and shaped such that water draining from the frame bottom end opening is diverted from the area immediately beneath the frame bottom end.

19. The apparatus of claim 15, wherein the upper seal means further comprises:

(a) a piston upper seal ring screw;

(b) the piston top further having a threaded piston screw hole and a piston alignment pin hole, the piston screw hole being sized for accepting the piston upper seal ring screw;

(c) the upper cylinder piston seat having a downwardly projecting radial ridge; and (d) the piston upper seal ring having a bottom portion and a top portion, the piston upper seal ring bottom portion having a top surface, a recess, a bottom portion screw hole, and a bottom portion alignment pin hole, the piston upper seal ring top portion having a top surface, an upper portion screw hole and a downwardly projecting alignment pin, the piston upper seal ring bottom portion and the piston upper seal ring top portion being sized such that the piston upper seal ring top portion is closely received by the piston upper seal ring bottom portion recess, and further such that the alignment pin, the bottom portion alignment pin hole and the piston alignment pin hole are aligned, and further such that the upper portion screw hole, the bottom portion screw hole, and the piston screw hole are aligned, and further such that the bottom portion top surface is flush with the upper portion top surface.

20. The apparatus of claim 19, further comprising:

(a) the frame also having a bottom end, the frame bottom end having an opening; and (b) light rain diversion means comprising the piston upper seal ring bottom portion having a channel, the channel being positioned on the piston upper seal ring bottom portion such that water above the piston upper seal ring slowly drains through the channel onto the piston top, the piston and the cylinder being sized such that water slowly drains from the piston top through the cylinder and through the frame bottom end opening when the piston is in its upper position.

21. The apparatus of claim 1, further comprising light rain diversion means.

22. The apparatus of claim 21, wherein the light rain diversion means comprises:

(a) the frame also having a bottom end, the frame bottom end having an opening; and (b) the piston and the cylinder being further sized such that water accumulated on the piston top will slowly drain through the cylinder and out of the frame bottom end opening when the piston is in its upper position.

23. The apparatus of claim 22, further comprising a drainage diverter, the drainage diverter being attached to the frame bottom end, the drainage diverter being positioned and shaped such that water draining from the frame bottom end opening is diverted from the area immediately beneath the frame bottom end.

24. The apparatus of claim 1, further comprising:

(a) the piston top being slanted toward the cylinder outlet port; and (b) piston anti-rotation means.

25. The apparatus of claim 24, wherein the piston anti-rotation means comprises:

(a) the frame having a piston key attached to the piston; and (b) the cylinder having a key slot for closely receiving the piston key, the piston key and cylinder key slot being oriented such that piston rotation within the cylinder is prevented.

26. The apparatus of claim 1, wherein the trough bias means comprises the trough, the trough being further pivotally attached such that when the trough is in its upper position, the center of gravity of the trough is disposed slightly closer to the frame than when the trough is in a vertical position.

27. The apparatus of claim 1, further comprising:

(a) a tab, the tab being attached to the trough remote end; and (b) a trough release, the trough release having a pivoting member, the pivoting member having a forward end, a rearward end and a pivot point interposed between the forward end and the rearward end such that the pivoting member moves from a first position to a second position, the trough release further having a latch bar, the latch bar being attached to the forward end of the pivoting member, the latch bar further having a notch, the notch being shaped for closely receiving the tab when the trough is in its upper position, the trough release being attached to the frame such that the tab bears upon the latch bar when the trough is returning to its upper position, causing the pivoting member to move to its second position, such pivoting movement allowing the tab to pass under the latch bar such that the pivoting member returns to its first position when the trough has completed its movement to the trough's upper position;

(c) a container, the container having a top, bottom, vent hole and a water feed hole, the container being attached to the rearward end of the pivoting member, the water feed hole being positioned near the container bottom, the vent hole being positioned near the container top, the container being sized in relation to the latch bar such that the forward end of the pivoting member is up when the container is substantially full and down when the container is substantially empty; and (d) a water feed passage for the delivery of water from the frame water passage to the container water feed hole, such that water is received into the container through the water feed hole when the height of the accumulated water in the frame water passage exceeds the height of the water feed hole.

28. The apparatus of claim 1, further comprising:

(a) a tab, the tab being attached to the trough remote end; and (b) a trough release, the trough release having a pivoting member, the pivoting member having a forward end, a rearward end and a pivot point interposed between the forward end and the rearward end such that the pivoting member moves from a first position to a second position, the trough release further having a latch bar, the latch bar being attached to the forward end of the pivoting member, the latch bar further having a notch, the notch being shaped for closely receiving the tab when the trough is in its upper position, the trough release being positioned such that the tab bears upon the latch bar when the trough is returning to its upper position, causing the pivoting member to move to its second position, such pivoting movement allowing the tab to pass under the latch bar such that the pivoting member returns to its first position when the trough has completed its movement to the trough's upper position;

(c) trough release attachment means for attaching the trough release to the rain gutter discharge;

(d) a container, the container having a top, bottom, vent hole and a water feed hole, the container being attached to the rearward end of the pivoting member, the water feed hole being positioned near the container bottom, the vent hole being positioned near the container top, the container being sized in relation to the latch bar such that the forward end of the pivoting member is down when the container is substantially empty, and up when the container is substantially full;

(e) connection means for attaching the frame to the rain gutter discharge such that the water received from the rain gutter discharge accumulates within the rain gutter discharge while the piston is in its upper position; and (f) a water feed passage for the delivery of water from the frame water passage to the container water feed hole, such that water is received into the container through the water feed hole when the height of the accumulated water in the rain gutter discharge exceeds the height of the water feed hole.

29. The apparatus of claim 28, wherein the connection means comprises:

(a) a connecting screw;

(b) a rain gutter discharge seal, the rain gutter discharge seal having a hole, the rain gutter discharge seal hole being shaped to closely receive the rain gutter discharge;

(c) the frame, the frame also having a frame top, the frame top having a threaded frame top connecting screw hole, a frame top recess, an inwardly projecting rain gutter discharge lower positioner shaped for closely receiving the rain gutter discharge, an inwardly projecting rain gutter discharge upper positioner shaped for closely receiving the rain gutter discharge, the upper positioner being further shaped and positioned with respect to the frame top recess such that the rain gutter discharge seal bears upon the upper positioner when the rain gutter discharge is within the frame top, the rain gutter discharge seal being further shaped such that it protrudes above the frame top, the upper positioner and lower positioner being shaped such that the rain gutter discharge is in a vertical position within the frame top, the frame top connecting screw hole being sized for accepting the connecting screw; and (d) a rain gutter discharge seal compressor, the seal compressor having a bottom recess, the seal compressor bottom recess being shaped for closely receiving the frame top, the seal compressor further having a seal compressor connecting screw hole shaped for closely receiving the connecting screw, an inwardly projecting rain gutter discharge positioner shaped for closely receiving the rain gutter discharge, and a seal compressor top recess shaped such that a trench is formed around the rain gutter discharge, the seal compressor and the frame top being positioned such that the frame top connecting screw hole is aligned with the seal compressor connecting screw hole, and further such that rotation of the connecting screw into the frame top connecting screw hole causes the seal compressor to bear upon the frame top and the rain gutter discharge seal to be compressed against the side of the rain gutter discharge, forming a seal therewith.

30. The apparatus of claim 1, wherein the trough bias means comprises a spring, the spring being sized, positioned and attached such that the spring exerts a return bias force on the trough in all trough positions.

31. The apparatus of claim 30, further comprising spring adjustment means for adjusting the tension in the spring.

32. The apparatus of claim 30, further comprising a trough stabilizer, the trough stabilizer being attached to the trough remote end, the trough stabilizer having a water collection reservoir and a drain hole, the trough stabilizer and the water collection reservoir being sized and oriented such that a portion of the water discharged from the trough remote end collects in the water collection reservoir, the drain hole being sized and oriented such that the water collection reservoir remains substantially full when water is being discharged from the trough remote end, the drain hole being further sized and oriented such that the collected water slowly drains from the water collection reservoir when water ceases to be discharged from the trough remote end, the trough and the trough stabilizer being sized such that the spring return bias force is overcome when the water collection reservoir is substantially full, and is not overcome when the water collection reservoir is substantially empty.

33. The apparatus of claim 32, further comprising:

(a) a tab, the tab being attached to the trough stabilizer; and (b) a trough release, the trough release having a pivoting member, the pivoting member having a forward end, a rearward end and a pivot point interposed between the forward end and the rearward end such that the pivoting member moves from a first position to a second position, the trough release further having a latch bar, the latch bar being attached to the forward end of the pivoting member, the latch bar further having a notch, the notch being shaped for closely receiving the tab when the trough is in its upper position, the trough release being attached to the frame such that the tab bears upon the latch bar when the trough is returning to its upper position, causing the pivoting member to move to its second position, such pivoting movement allowing the tab to pass under the latch bar such that the pivoting member returns to its first position when the trough has completed its movement to the trough's upper position;

(c) a container, the container having a top, bottom, vent hole and a water feed hole, the container being attached to the rearward end of the pivoting member, the water feed hole being positioned near the container bottom, the vent hole being positioned near the container top, the container being sized in relation to the latch bar such that the forward end of the pivoting member is down when the container is substantially empty, and up when the container is substantially full; and (d) a water feed passage for the delivery of water from the frame water passage to the container water feed hole, such that water is received into the container through the water feed hole when the height of the accumulated water in the frame water passage exceeds the height of the water feed hole.

34. The apparatus of claim 32, further comprising:

(a) a tab, the tab being attached to the trough stabilizer;

(b) a trough release, the trough release having a pivoting member, the pivoting member having a forward end, a rearward end and a pivot point interposed between the forward end and the rearward end such that the pivoting member moves from a first position to a second position, the trough release further having a latch bar, the latch bar being attached to the forward end of the pivoting member, the latch bar further having a notch, the notch being shaped for closely receiving the tab when the trough is in its upper position, the trough release being positioned such that the tab bears upon the latch bar when the trough is returning to its upper position, causing the pivoting member to move to its second position, such pivoting movement allowing the tab to pass under the latch bar such that the pivoting member returns to its first position when the trough has completed its movement to the trough's upper position;

(c) trough release attachment means for attaching the trough release to the rain gutter discharge;

(d) a container, the container having a top, bottom, vent hole and a water feed hole, the container being attached to the rearward end of the pivoting member, the water feed hole being positioned near the container bottom, the vent hole being positioned near the container top, the container being sized in relation to the latch bar such that the forward end of the pivoting member is down when the container is substantially empty, and up when the container is substantially full;

(e) connection means for attaching the frame to the rain gutter discharge such that the water received from the rain gutter discharge accumulates within the rain gutter discharge while the piston is in its upper position; and (f) a water feed passage for the delivery of water from the frame water passage to the container water feed hole, such that water is received into the container through the water feed hole when the height of the accumulated water in the rain gutter discharge exceeds the height of the water feed hole.

35. The apparatus of claim 34, wherein the connection means comprises:

(a) a connecting screw;

(b) a rain gutter discharge seal, the rain gutter discharge seal having a hole, the rain gutter discharge seal hole being shaped to closely receive the rain gutter discharge;

(c) the frame, the frame also having a frame top, the frame top having a threaded frame top connecting screw hole, a frame top recess, an inwardly projecting rain gutter discharge lower positioner shaped for closely receiving the rain gutter discharge, an inwardly projecting rain gutter discharge upper positioner shaped for closely receiving the rain gutter discharge, the upper positioner being further shaped and positioned with respect to the frame top recess such that the rain gutter discharge seal bears upon the upper positioner when the rain gutter discharge is within the frame top, the rain gutter discharge seal being further shaped such that it protrudes above the frame top, the upper positioner and lower positioner being shaped such that the rain gutter discharge is in a vertical position within the frame top, the frame top connecting screw hole being sized for accepting the connecting screw; and (d) a rain gutter discharge seal compressor, the seal compressor having a bottom recess, the seal compressor bottom recess being shaped for closely receiving the frame top, the compressor further having a seal compressor connecting screw hole shaped for closely receiving the connecting screw, an inwardly projecting rain gutter discharge positioner shaped for closely receiving the rain gutter discharge, and a seal compressor top recess shaped such that a trench is formed around the rain gutter discharge, the seal compressor and the frame top being positioned such that the frame top connecting screw hole is aligned with the seal compressor connecting screw hole, and further such that rotation of the connecting screw into the frame top connecting screw hole causes the seal compressor to bear upon the frame top and the rain gutter discharge seal to be compressed against the side of the rain gutter discharge, forming a seal therewith.

36. The apparatus of claim 32, further comprising shock absorber means for absorbing impact forces between the trough stabilizer and an underlying surface when the trough stabilizer impacts the underlying surface during movement toward the trough lower position.

37. The apparatus of claim 36, wherein the shock absorber means comprises:

(a) the trough stabilizer, the trough stabilizer further being pivotally attached to the trough remote end; and (b) a shock absorber spring, the shock absorber spring being attached to the trough remote end and the trough stabilizer such that the shock absorber spring force resists, but does not prevent, rotation of the trough stabilizer with respect to the trough remote end.

38. The apparatus of claim 1, wherein the trough bias means comprises:

(a) a lower trough return member pivotally attached to the frame;

(b) an upper trough return member pivotally attached to the trough and pivotally attached to the lower trough return member; and (c) a spring, the spring being attached to the frame and the lower trough return member, the spring being in tension such that it exerts a return bias force on the trough in all trough positions.

39. The apparatus of claim 38, further comprising spring adjustment means for adjusting the tension in the spring.

40. The apparatus of claim 1, further comprising shock absorber means for absorbing impact forces between the trough and an underlying surface when the trough impacts the underlying surface during movement toward the trough lower position.

41. An apparatus to improve rain gutter water conveyance devices of the type in which a trough, having a remote end, is automatically raised by a trough return force means after water flow ceases, the improvement comprising a trough stabilizer, the trough stabilizer being attached to the trough remote end, the trough stabilizer having a water collection reservoir and a drain hole, the trough stabilizer and the water collection reservoir being sized and oriented such that a portion of the water discharged from the trough remote end collects in the water collection reservoir, the drain hole being sized and oriented such that the water collection reservoir remains substantially full when water is being discharged from the trough remote end, the drain hole being further sized and oriented such that the collected water slowly drains from the water collection reservoir when water ceases to be discharged from the trough remote end, the trough and the trough stabilizer being sized such that the trough return force means is overcome when the water collection reservoir is substantially full, and is not overcome when the water collection reservoir is substantially empty.

42. The apparatus of claim 41, further comprising:

(a) the trough stabilizer, the trough stabilizer further being pivotally attached to the trough remote end; and (b) a shock absorber spring, the shock absorber spring being attached to the trough remote end and the trough stabilizer such that the shock absorber spring force resists, but does not prevent, rotation of the trough stabilizer with respect to the trough remote end.

43. An apparatus for conveying liquid from a liquid collection system discharge to a point remote from such discharge, which comprises:

(a) a piston having a top;

(b) a frame, the frame having a top end, the frame further having a cylinder for closely receiving the piston and allowing movement of the piston between an upper position and a lower position, the frame further having a cylinder outlet port, the frame further having a liquid passage for receiving and transporting liquid such that the liquid accumulates and bears upon the piston top while the piston is in its upper position;

(c) a trough, the trough having a near end and a remote end, the trough being pivotally attached to the frame for movement between an upper position and a lower position, the trough being attached and oriented such that it receives liquid from the cylinder outlet port into the trough near end when the trough is in its lower position, the trough being further attached and oriented such that the liquid drains from the trough near end to the trough remote end when the trough is in its lower position;

(d) trough bias means for biasing the trough to remain in its upper position; and (e) a linkage for linking the piston to the trough, the linkage being oriented such that the trough bias means causes a force on the piston in opposition to the force exerted by the liquid bearing upon the piston, and further such that the piston remains in its upper position until the liquid force exceeds the trough bias means force, the linkage being further oriented such that downward movement of the piston from its upper position causes downward movement of the trough from its upper position.

44. The apparatus of claim 43, further comprising connection means for receiving liquid into the frame liquid passage from the liquid collection system discharge, the connection means comprising the frame, the frame having a frame top, the frame top being sized to closely receive the liquid collection system discharge.

* * * * *

UNITED STATES PATENT AND TRADEMARK OFFICE

CERTIFICATE OF CORRECTION

PATENT NO. : 5,522,427
DATED : June 4, 1996
INVENTOR(S) : Charles L. Johnson

It is certified that error appears in the above-identified patent and that said Letters Patent is hereby corrected as shown below:

The sheet of drawing consisting of figures 10a, 10b and fig. 11, should be deleted to appear as per attached sheet.

Signed and Sealed this

Nineteenth Day of August, 1997

*Attest:*

*Attesting Officer*

BRUCE LEHMAN

*Commissioner of Patents and Trademarks*

Patent No: 5,522,427